United States Patent [19]

Gladh

[11] 4,342,619

[45] Aug. 3, 1982

[54] ADJUSTABLE PAPER MACHINE HEADBOX WITH ADJUSTMENT SENSING MEANS

[75] Inventor: Arne I. L. Gladh, Skoghall, Sweden

[73] Assignee: Billerud Uddeholm Aktiebolag, Saffle, Sweden

[21] Appl. No.: 224,283

[22] PCT Filed: Dec. 27, 1978

[86] PCT No.: PCT/SE78/00104

§ 371 Date: Aug. 8, 1979

§ 102(e) Date: Aug. 8, 1979

[87] PCT Pub. No.: WO79/00643

PCT Pub. Date: Sep. 6, 1979

[30] Foreign Application Priority Data

Feb. 21, 1978 [SE] Sweden ..... 7802001

[51] Int. Cl.[3] ..... D21F 1/02

[52] U.S. Cl. ..... 162/262; 33/147 L; 33/147 N; 33/174 PA; 33/174 PB; 162/259; 162/263; 162/347

[58] Field of Search ..... 162/344, 345, 346, 347, 162/263, 259, 192, 198, 262; 33/172 E, 147 L, 147 N, 174 P, 174 PA, 174 PB

[56] References Cited

U.S. PATENT DOCUMENTS

| | | | |
|---|---|---|---|
| 2,022,298 | 11/1935 | Neilson . | |
| 2,779,253 | 1/1957 | Owens | 162/263 |
| 3,463,701 | 8/1969 | Curtis | 162/259 |
| 3,976,539 | 8/1976 | Kirgavainen | 162/347 |
| 3,994,773 | 11/1976 | Wolf et al. | 162/259 |

OTHER PUBLICATIONS

Macdonald, Editor; Pulp and Paper Manufacture, 2nd Edition, vol. III; McGraw-Hill, (N.Y.), 1970, pp. 271-272.

*Primary Examiner*—Steve Alvo

*Attorney, Agent, or Firm*—Murray and Whisenhunt

[57] ABSTRACT

In a paper machine headbox a profile bar (15) is mounted on a top slice lip (12). The profile bar is locally displaceable in the vertical direction by means of a plurality of adjusting assemblies (16) distributed along the top slice lip. Each adjustment assembly comprises an electrical level sensor (21) in the form of a differential transformer, the core (23) of which is affixed to the profile bar, while the coil (22) of the differential transformer is affixed to the top slice lip. The differential transformer is electrically connected to an indicator (24).

2 Claims, 2 Drawing Figures

ADJUSTABLE PAPER MACHINE HEADBOX WITH ADJUSTMENT SENSING MEANS

TECHNICAL FIELD

This invention relates to paper machine headboxes. More particularly the invention relates to a headbox of the type in which a slice opening running the full width of the headbox for discharging pulp stock is formed by a bottom slice lip, and a rigid top slice lip which can be raised or lowered over the full width of the headbox, said top slice lip being provided with a bendable profile bar running the full width of the headbox, said profile bar limiting a pulp stock discharge nozzle in the vertical direction and being locally displaceable in the vertical direction by means of a plurality of adjusting assemblies distributed along the top slice lip in order to allow local adjustments of the height of the pulp stock discharge nozzle.

BACKGROUND ART

In paper machine headboxes of the present type, the profile bar on the top slice lip serves to "modulate" the flow of the pulp stock through the horizontal slice opening in the transverse direction, i.e. to allow a control of the grammage of the paper in the transverse direction of the paper web. The adjustment of the profile bar relative to the top slice lip is carried out by means of adjusting knobs or the like, which can be reached by an operator from a bridge that transverses the paper making machine. In connection with these adjusting knobs or corresponding means there are provided reading instruments showing the recorded position of the profile bar. However, due to unavoidable play in the transmission between the profile bar and the reading instruments, the indication is unsafe wherefore the recorded position can deviate from the real position of the profile bar. The deviation often is greater than can be tolerated.

DISCLOSURE OF THE INVENTION

At the headbox of the present invention, the indication can be performed with a very high accuracy. In fact, the present invention is characterized in that each adjustment assembly comprises an electrical level sensor with two members which are movable relative to each other, one member being mechanically connected to the profile bar without play, while the second member is mechanically connected to the top slice lip without play, said level sensor being electrically connected with an indicator.

By this system which readily can be installed also for already existing headboxes, any influence upon the indication from play in the mechanical transmission between the profile bar and the adjusting knobs or corresponding means is eliminated. The indicator of course can be individual for each level sensor but preferably it is joint for all level sensors. In the latter case it is provided with a selector by means of which one level sensor at a time may be selected for indication. The indication equipment advantageously may be completed with a selector device which automatically selects all level sensors in their proper turns, and with a recorder or other registering instrument which registers the measurement result received from each level sensor. The level sensors provided according to the invention of course can be integrated in a regulation system which automatically provides for a proper adjustment of the profile bar.

BRIEF DESCRIPTION OF DRAWINGS

An embodiment of the invention will now be explained with reference to the accompanying drawings in which.

BEST MODE OF CARRYING OUT THE INVENTION

Figure 1:
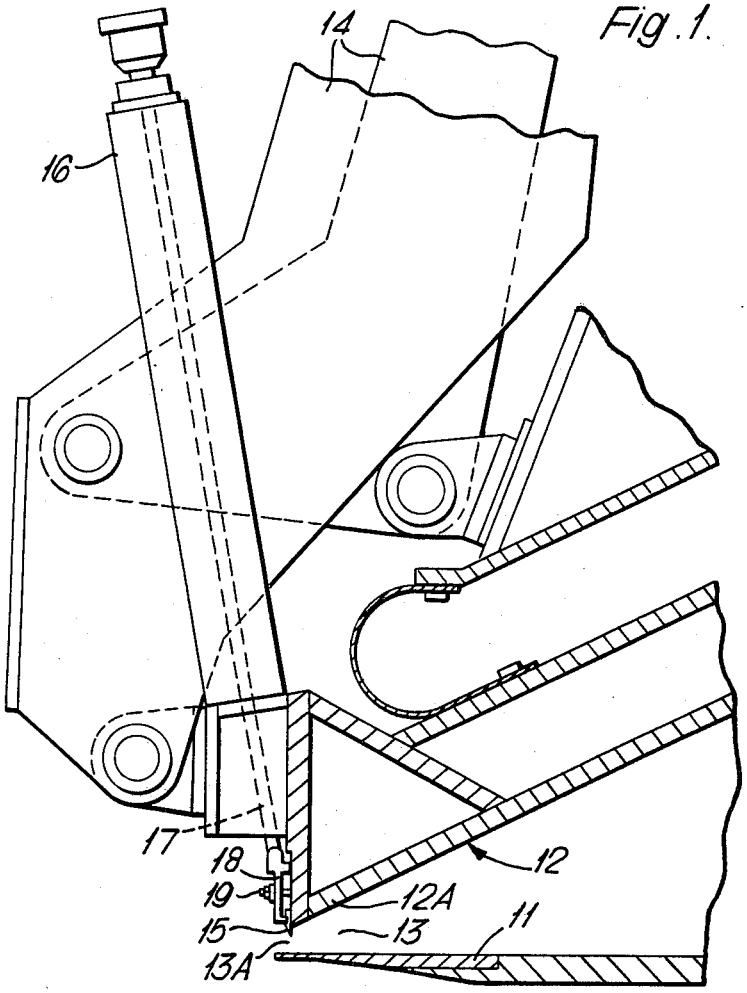
FIG. 1 schematically shows a section through the slice of a headbox provided according to the invention.
Figure 2:
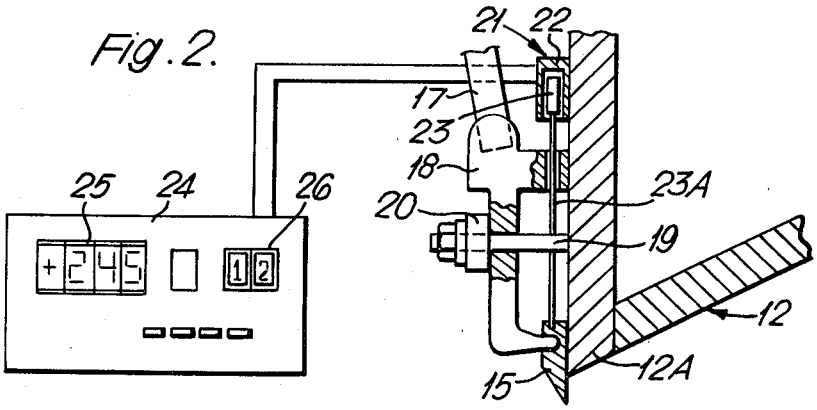
FIG. 2 shows more in detail a section through a profile bar and adjacent portions of a top slice lip.

The headbox slice of the headbox, shown in FIG. 1 comprises a fixed bottom slice lip 11 and a top slice lip 12 which is mounted above the bottom slice lip 11 and provided so that it can be raised or lowered. The two slice lips 11 and 12 run the full width of the paper machine headbox and define between them an horizontal slice opening 13 for discharging the diluted pulp stock. The pulp stock is supplied to the portion of the headbox which is not shown in FIG. 1, said headbox being exerted to an overpressure. The top slice lip 12 is designed as a box girder and is sufficiently rigid to resist any noticeable bending influenced by the pressure from the pulp stock that is being discharged. The portion 12A of the top slice lip which is most adjacent to the bottom slice lip 11 is always kept parallel with the bottom slice lip and is thus always raised or lowered uniformly over the full width of the paper machine headbox. The raising and lowering operations are carried out by means of jacks, which are not shown in the drawing, via a link mechanism 14.

A ruler-shaped profile bar 15 running the full width of the paper machine headbox is supported against the substantially vertical front wall of the bottom portion 12 A of the top slice lip, said bottom portion projecting downwards from the top slice lip to define a border of the pulp stock discharge nozzle 13A. The ruler-shaped profile bar 15 is arranged edgeways and has a cross section which is comparatively elongated in the vertical direction, but due to its long length it can nevertheless be bent in the vertical direction. Therefore it is possible to change the curvature of the profile bar 15 by locally raising or lowering the profile bar on the top slice lip in order locally to vary the height of the discharge nozzle 13A. Such displacement of the profile bar 15 can be carried out individually by means of any of a plurality of adjusting assemblies, one adjusting assembly generally being shown as 16 in the drawing, said adjusting assemblies being distributed along the width of the paper machine headbox.

Each adjusting assembly comprises an adjusting spindle 17 which can be controlled from a bridge over the paper making machine, and a lever assembly connected to the spindle 17. The lever assembly comprises a clamp block 18 which is pivotally connected to a pin 19 attached to the top slice lip, with one lever arm connected to the adjusting spindle 17 and with the other lever arm connected to the profile bar 15. A clamp means 20 is provided, via the lever, to keep the profile bar 15 snug fit against the front wall of the top slice lip. By rotating the adjusting spindle 17, the lever 18 is turned on the pin 19 so that the adjacent part of the profile bar 15 is displaced upwards or downwards as the case may be relative to the top slice lip 12.

Further each adjusting assembly 16 includes an electrical level sensor 21 comprising two members which are movable relative to each other. One member is secured to the top slice lip 12 while the second member is secured to the profile bar 15. The level sensor 21 according to the embodiment consists of a differential transformer, the coiling 22 of which is secured to the front wall of the top slice lip 12, while the magnetic core 23 of the transformer is secured to the profile bar 15 via a micro-rod 23A. When the profile bar 15 is in a neutral position the level sensor 21 does not transmit any output signal, but as soon as the level of the profile bar 15 in the vertical direction relative to the top slice lip 12 is changed the level sensor 21 will transmit an output signal, the sign and magnitude of which depends on the direction and extent of the change.

Due to the fact that the two level sensor members are firmly connected to the top slice lip 12 and to the profile bar 15, respectively, there is no risk for play and consequently no indication error caused by play at the transforming of the relative movements of the top slice lip and the profile bar to the signal transmitter, and hence the indication can be performed with as great accuracy as the design of the level sensor may allow. It is true that the micro-rod 23A is deformable to allow a suitable location of the signal transmitter (thus the micro-rod need not necessarily be straight) but at the same time it is sufficiently rigid to ensure that the core 23 accurately will follow the movements of the profile bar 15.

In the above described example of an embodiment of the invention the level sensor is a differential transformer (e.g. type BOFORS REG±2.5 mm) but it is of course possible to utilize also other types of electrical level sensors, i.e. level sensors which may generate an electrical and consequently readily transferable and transformable output signal.

In this specification it has been indicated that the members of the level sensor 21 are firmly affixed to the top slice lip 12 and to the profile bar 15, respectively. However, it is not a requirement that the members are completely prevented from moving relative to the top slice lip, and to the profile bar respectively; the freedom of movement need only be restricted to the extent that is necessary for obtaining a freedom from play in the vertical direction when transferring the movements.

All the level sensors 21 are electrically connected to a joint digital type indicator 24. This indicator has a display panel 25 where the output signal from a level sensor 21 that is selected on a certain occasion, i.e. representing the level of a corresponding portion of the profile bar 15 relative to the top slice lip 12, is indicated with sign and numerical value. The level sensor 21 may be manually selected by means of a selector switch 26, but the indicator 25 also comprises an automatic selector switch which can be trigged by means of a starting button in order automatically to connect all level sensors 21 successively in their proper turns at a comparatively high rate. A recorder which is not illustrated in the drawing will register the output signals from the level sensors and/or produces a diagram showing the position, i.e. the curvature, of the profile bar 15 relative to the top slice lip 12 over the whole width of the paper machine headbox.

I claim:

1. Paper machine headbox of the type in which a slice opening running the full width of the headbox for discharging pulp stock is formed by a bottom slice lip, and a rigid top slice lip which can be raised or lowered over the full width of the headbox, said top slice lip being provided with a ruler shaped bendable profile bar running the full width of the headbox, said profile bar limiting a pulp stock discharge nozzle in the vertical direction and being locally displacable in the vertical direction by means of a plurality of adjusting assemblies distributed along the top slice lip in order to allow local adjustments of the height of the pulp stock discharge nozzle, characterized in that each adjustment assembly comprises an electrical level sensor (21) with two members, a coil (22) and a magnet core (23), which are moveable relative to each other, said magnet core (23) being mechanically attached to the profile bar with a rigid connection by means of a micro-rod, while the coil (22) is mechanically connected to the top slice lip (12) without play, said level sensor (21) being electrically connected with an indicator (24), characterized in that the indicator (24) receives the signals for all level sensors (21) and comprises means for selecting level sensors for which indications shall be performed.

2. Headbox according to claim 1, characterized in that the level sensor (21) is a differential transformer.

* * * * *